US008800580B2

(12) United States Patent
Heim

(10) Patent No.: US 8,800,580 B2
(45) Date of Patent: Aug. 12, 2014

(54) NORDIC WALKING POLE WITH BUFFER

(75) Inventor: Eberhard Heim, Unterensingen (DE)

(73) Assignee: Lekisport AG, Barr (CH)

( * ) Notice: Subject to any disclaimer, the term of this patent is extended or adjusted under 35 U.S.C. 154(b) by 0 days.

(21) Appl. No.: 13/640,632

(22) PCT Filed: Apr. 6, 2011

(86) PCT No.: PCT/EP2011/055296

§ 371 (c)(1),
(2), (4) Date: Nov. 28, 2012

(87) PCT Pub. No.: WO2011/128231

PCT Pub. Date: Oct. 20, 2011

(65) Prior Publication Data

US 2013/0068268 A1 Mar. 21, 2013

(30) Foreign Application Priority Data

Apr. 14, 2010 (CH) ..... 0533/10

(51) Int. Cl.
*A45B 9/04* (2006.01)
*A63C 11/22* (2006.01)
*A61H 3/02* (2006.01)

(52) U.S. Cl.
CPC ..... *A45B 9/04* (2013.01); *A61H 3/0288* (2013.01); *A63C 11/22* (2013.01)
USPC ..... 135/81; 135/78; 135/86; 280/819

(58) Field of Classification Search
CPC .. A45B 9/04; A45B 2200/055; A61H 3/0288; A61H 3/0277; A63C 11/22; A63C 2203/20; A63C 11/025; A63C 5/052
USPC ..... 135/65, 69, 70, 77, 86, 78, 80–82, 84; 280/817–819
See application file for complete search history.

(56) References Cited

U.S. PATENT DOCUMENTS 39,854 A * 9/1863 Wemple ..... 135/68
415,511 A * 11/1889 Howgate ..... 135/81

(Continued)

FOREIGN PATENT DOCUMENTS

CH 384 148 A 11/1964
DE 4406062 A1 * 9/1994

(Continued)

*Primary Examiner* — Winnie Yip
(74) *Attorney, Agent, or Firm* — Sughrue Mion, PLLC

(57) ABSTRACT

A pole, in particular a Nordic walking pole, is described, having a pole body (1) at the lower end of which a buffer (2) with a tip (19) is provided, wherein the tip (19) and/or a lowermost portion (28, 36) of an inner sleeve (3) secured to the pole body (1) are arranged passing through a central opening (18) of the buffer (2), wherein the buffer (2) is mounted such that it can be moved and secured in an axial direction in this central opening (18), and wherein the buffer (2) can be secured in at least two axially different positions in relation to the pole body (1) via a form-fit connection. This pole is preferably characterized in that the buffer (2) comprises an outer sleeve (25) engaging around and mounted axially movably on the inner sleeve (3), on the outside of which outer sleeve (25) a latching lever (4) is articulated, wherein the latching lever (4), at its lower end (6) directed towards the rolling surface (13), is articulated on the outer sleeve (25), and, at its upper end (7) in the secured position of the buffer (2), engages around the pole body (1) and/or the inner sleeve (3) at least partially with a form fit and can be released by being pivoted away from the outer sleeve (25).

19 Claims, 6 Drawing Sheets

(56) References Cited

U.S. PATENT DOCUMENTS

| | | | | | |
|---|---|---|---|---|---|
| 862,455 | A | * | 8/1907 | Dunkel | 135/70 |
| 1,298,721 | A | * | 4/1919 | Hguhes | 135/81 |
| 2,480,382 | A | * | 8/1949 | Pagliuso | 248/188.5 |
| 2,492,916 | A | * | 12/1949 | Chute et al. | 135/80 |
| 3,177,884 | A | * | 4/1965 | Thro | 135/77 |
| 3,646,949 | A | * | 3/1972 | Streeter | 135/80 |
| 4,411,284 | A | * | 10/1983 | Opitz | 135/81 |
| 4,977,914 | A | * | 12/1990 | Smerker | 135/81 |

FOREIGN PATENT DOCUMENTS

| | | | | |
|---|---|---|---|---|
| DE | 20 2007 011083 | U1 | | 11/2007 |
| DE | 10 2008 019 181 | A1 | | 10/2009 |
| FR | 2942700 | A1 | * | 9/2010 |
| JP | 05246216 | A | * | 9/1993 |
| WO | 2005/120281 | A1 | | 12/2005 |
| WO | WO 2006019303 | A1 | * | 2/2006 |
| WO | WO 2006047803 | A1 | * | 5/2006 |
| WO | WO 2006047804 | A1 | * | 5/2006 |
| WO | 2008/037098 | A1 | | 4/2008 |

* cited by examiner

NORDIC WALKING POLE WITH BUFFER

CROSS REFERENCE TO RELATED APPLICATIONS

This application is a National Stage of International Application No. PCT/EP2011/055296 filed Apr. 6, 2011, claiming priority based on Switzerland Patent Application No. 00533/10 filed Apr. 14, 2010, the contents of all of which are incorporated herein by reference in their entirety.

TECHNICAL FIELD

The present invention relates to a pole for use as sports equipment, in particular as a Nordic walking pole according to the features of the preamble of claim 1.

PRIOR ART

A plurality of Nordic walking poles are known from the prior art, not least because the type of sport Nordic walking is enjoying great popularity among a broad section of the population.

WO 2005/120281 discloses such a Nordic walking pole which comprises a handle with a loop, a pole body, a pole tip and a rubber buffer in the area of the pole tip. The pole tip is axially displaceable in the direction of the pole axis in such a manner that the tip extends from the rolling surface of the rubber buffer or that the tip is completely retracted so that no parts of the rubber buffer extend over the rolling surface. For this purpose the buffer is typically turned through a specific angle about the pole axis, axially displaced and then turned back again through the same angle. The user can accordingly make the choice, according to the ground, whether the pole should be used with the rubber buffer or with the extended tip. On a forest path or a path through fields with coarser stones or gravel and soft ground, the user for example selects the extended tip. On an asphalt road with a hard, usually fairly smooth surface the user preferably selects the rubber buffer.

CH 384 148 discloses a protective device for pole tips. The said protective device is axially displaceable along the pole axis and can be fixed with an adjusting screw or a quick release device. In this case, the protective sleeve can have different positions, namely for example, a position which releases the pole tip or a position which protects the pole tip. The protective tip is non-positively firmly clamped by means of a force which is applied through the adjusting screw or the quick release device radially to the circumference of the pole body.

A disadvantage with the poles of the prior art is generally that the change from the use of the tip to the rubber or the rubber buffer to the tip is complex and laborious.

Another disadvantage arises from the fact that many of these buffers could be displaced in the axial direction when there is a larger force in the axial direction, that is in the direction of the pole axis.

In addition, adjustable pole tips are liable to contamination. In particular on wet paths, dirt can collect between the pole tip and the pole body. Since only a small play should be provided between pole tip and pole body, the penetration of dirt can impede or even make impossible any movement of the pole tip.

Known from WO 2008/037098 is a pole, in particular a Nordic walking pole, which comprises a pole body at the lower end whereof a tip body and a buffer are provided. The buffer is mounted displaceably so that it can be fixed in an axial direction to the pole body. The buffer can be fixed in at least two axially different positions by means of a positive connection in relation to the pole body. The tip body and/or the lowermost portion of the pole body are arranged to pass through a central opening of the buffer and the buffer can be fixed in an axial direction to the pole body in this central opening.

DESCRIPTION OF THE INVENTION

It is accordingly the object of the present invention to provide an improved buffer for a pole, in particular for a Nordic walking pole, which allows it to be changed simply between a position with extended tip and a position with retracted tip, which has no loose parts and in which the buffer need not be removed and then stowed away for the conversion. Specifically this involves the improvement of a buffer or especially a pole having a pole body, at the lower end of which a buffer with a tip is provided, wherein the tip and/or a lowermost portion of an inner sleeve secured to the pole body are arranged passing through a central opening (in the running surface or rolling surface) of the buffer, wherein the buffer is mounted so that it can be moved and secured in an axial direction (in relation to the pole axis) to the pole body in this central opening, and wherein the buffer can be secured in at least two axially different positions in relation to the pole body or the inner sleeve via a form-fit connection. In such a pole or buffer, the buffer is characterised according to the invention by an outer sleeve engaging around and mounted axially movably on the inner sleeve, on the outside of which outer sleeve a latching lever is articulated, wherein the latching lever, at its lower end directed towards the rolling surface, is articulated on the outer sleeve and, at its upper end in the secured position of the buffer, engages around the pole body and/or the inner sleeve at least partially with a form fit and can be released by being pivoted away from the outer sleeve.

The form fit ensures a constructively simple but as secure as possible fixing which is scarcely susceptible to dirt. As a result of the external arrangement of the latching lever, this can easily be actuated by hand from outside and is scarcely susceptible to dirt, this is in contrast to constructions in which such a latching lever is installed inside the outer sleeve. Nevertheless, however in the folded-in state, that is when one of the two positions is fixed positively, the latching lever can engage at least partially in an indentation of the outer sleeve and can be arranged, for example, at least in sections or even completely flush with the contour of this. As a result of the axis of rotation of the latching lever located at the bottom, the region located at the top and barely exposed to dirt can be used for the form fit. The form fit is additionally ensured whereby the upper end of the latching lever engages at least partially around the inner sleeve or the pole tube.

According to a first preferred embodiment, the latching lever in the secured position of the buffer (or preferably in both secured positions) engages at least partially around the inner sleeve, preferably by more than half the circumference of the inner sleeve. In particular, the latter design is preferred since by this means whilst simultaneously using a slightly flexible (but non-elastomeric) material for the latching lever, a, to a certain extent, automatic snapping-in of the same around the inner sleeve can be achieved constructively very simply. The latching lever can thus be fixed entirely without spring mounting and simply only by axial mounting on the outer sleeve, which further simplifies the construction and nevertheless optimally fixes both positions. According to a further preferred embodiment, an at least partially circumferential extension (in the sense of a rib running at least partially around the pole axis, typically having a width in the axial direction in the range of 1-10 mm, preferably in the range of 2-6 mm) and/or an at least partially circumferential indentation (in the sense of a groove running at least partially around the pole axis) can be provided on the inner sleeve in the engagement region of the lever, on or in which the upper end of the latching lever acts or engages positively.

Such an embodiment is further preferably characterised in that on the inner side of the upper end of the latching lever a projection in the form of a contact region (in the sense of an inwardly directed flange or a circumferential inwardly directed rib, this can be configured to be corresponding and adapted to the aforesaid rib on the inner sleeve) is provided on the circumference of the inner sleeve and an undercut (in the sense of a preferably at least partially circumferential groove) following directly in the direction of the axis of rotation (that is downwards) is provided for contact on the circumference of the extension in at least one secured position.

A further preferred embodiment is characterised in that the axis of rotation of the latching lever is disposed substantially perpendicular to the pole axis, that is preferably running transversely to this and offset laterally from this, and that preferably outwardly projecting bearing extensions are provided on the outer sleeve in order to mount this axis of rotation in axial holes.

A further preferred embodiment is characterised in that the outer sleeve comprises a buffer attachment at the lower end thereof, which can be detachably secured to the outer sleeve, preferably with the aid of a securing pin running transversely to the pole axis. It is quite particularly preferred if this securing pin at the same time serves as an anti-turn device for the displacement of the outer sleeve on the inner sleeve. On the one hand, this facilitates assembly as will be explained further below and on the other hand ensures the exchangeability and the anti-turn locking of the two components relative to one another.

Quite generally preferably inner sleeve and outer sleeve as well as preferably the latching lever consist of a metal or a substantially inflexible thermoplastic hard plastic such as polyethylene, polycarbonate, polyamide, ABS, PVC and optionally fibre-reinforced forms thereof. Multi-component components are also possible here (e.g. combinations of metal and plastic). The buffer attachment is preferably formed from an elastomeric material such as, for example, from a thermoplastic elastomer such as, for example, TPE, TPU (TPU=urethane-based thermoplastic elastomers) or vulcanised rubber, or said buffer attachment can also be formed as a two-component component having a securing region made of a substantially inflexible hard plastic and having an elastomeric region forming the rolling surface. Spikes can also be let into the rolling surface of the buffer attachment, as is known for example from WO 2006/128312.

A further preferred embodiment is characterised in that in an upper region the inner sleeve has an axial recess for receiving and securing the pole body and the tip is secured in a lower region (at the lower end) of the inner sleeve. Quite generally the tip preferably comprises a separate metal tip, in particular made of hardened and/or coated metal or of ceramic or of a combination of such materials. It is further preferred that the tip is secured in an axial recess of the lower part of the inner sleeve.

The tip can be secured directly on the lower region of the inner sleeve or by means of a separate securing element (for example, made of metal or plastic), which has an upper securing stub which is secured in a recess in the lower region of the inner sleeve, and adjoining in the downward direction, a flange preferably only extending in the running direction towards the front and back preferably followed in the downward direction by a lower securing stub in which a tip is let in and secured in a recess. In order to predefine the rotation position of the securing element relative to the inner sleeve, the upper securing stub can preferably have a non-circular cross-section and accordingly, the recess of the inner sleeve, in which the securing stub is let in, has a corresponding non-circular cross-section.

As already mentioned further above, during an axial displacement of inner sleeve relative to outer sleeve, it is preferable to prevent these two elements from being able to twist simultaneously. Accordingly, according to a further preferred embodiment, means are provided, which, in the event of an axial displacement of the outer sleeve relative to the inner sleeve, prevent a twisting of these two elements relative to one another about the pole axis, wherein this means preferably comprises a guide pin running transversely to the pole axis, which engages in a guide recess (or guide indentation) of the inner sleeve which allows axial displacement but not twisting.

The outer sleeve can preferably be fixed in two positions relative to the inner sleeve but it is also possible to provide a plurality of, for example, three different positions. If two or only two such positions are provided, it is preferable that in an upper position of the outer sleeve relative to the inner sleeve, the tip is arranged so that it projects downwards over the rolling surface, preferably projecting in the range of 2-10 mm, and in a lower position of the outer sleeve the tip does not project over the rolling surface, wherein this is preferably arranged in this second position 2-10 mm above (or behind) the rolling surface and embedded in the buffer, and wherein these two positions are each fixed positively by means of the latching lever.

The present invention further relates to a buffer for such a pole. In addition, the present invention relates to a method for mounting a pole as has been described above, where this method is preferably characterised in that the outer sleeve without attachment with buffer element is pushed onto the inner sleeve and that the attachment is then put in place and is secured with the securing pin on the outer sleeve, wherein the securing pin engages in a guide recess in the inner sleeve so that inner sleeve and outer sleeve are only displaceable in a torque-proof manner in the axial region predefined by the guide recesses.

According to a first preferred embodiment, this method is characterised in that the inner sleeve is secured on the pole body, preferably by securing the pole body in a recess in the upper region of the inner sleeve, wherein the tip can preferably be secured by means of a securing element on the inner sleeve or can be secured thereafter on the inner sleeve. Further embodiments are given in the dependent claims.

BRIEF DESCRIPTION OF THE DRAWINGS

Preferred embodiments of the invention are explained hereinafter with reference to the drawings, which merely serve for explanation and are not to be interpreted as restrictive. In the drawings.

DESCRIPTION OF PREFERRED EMBODIMENTS

Figure 1:
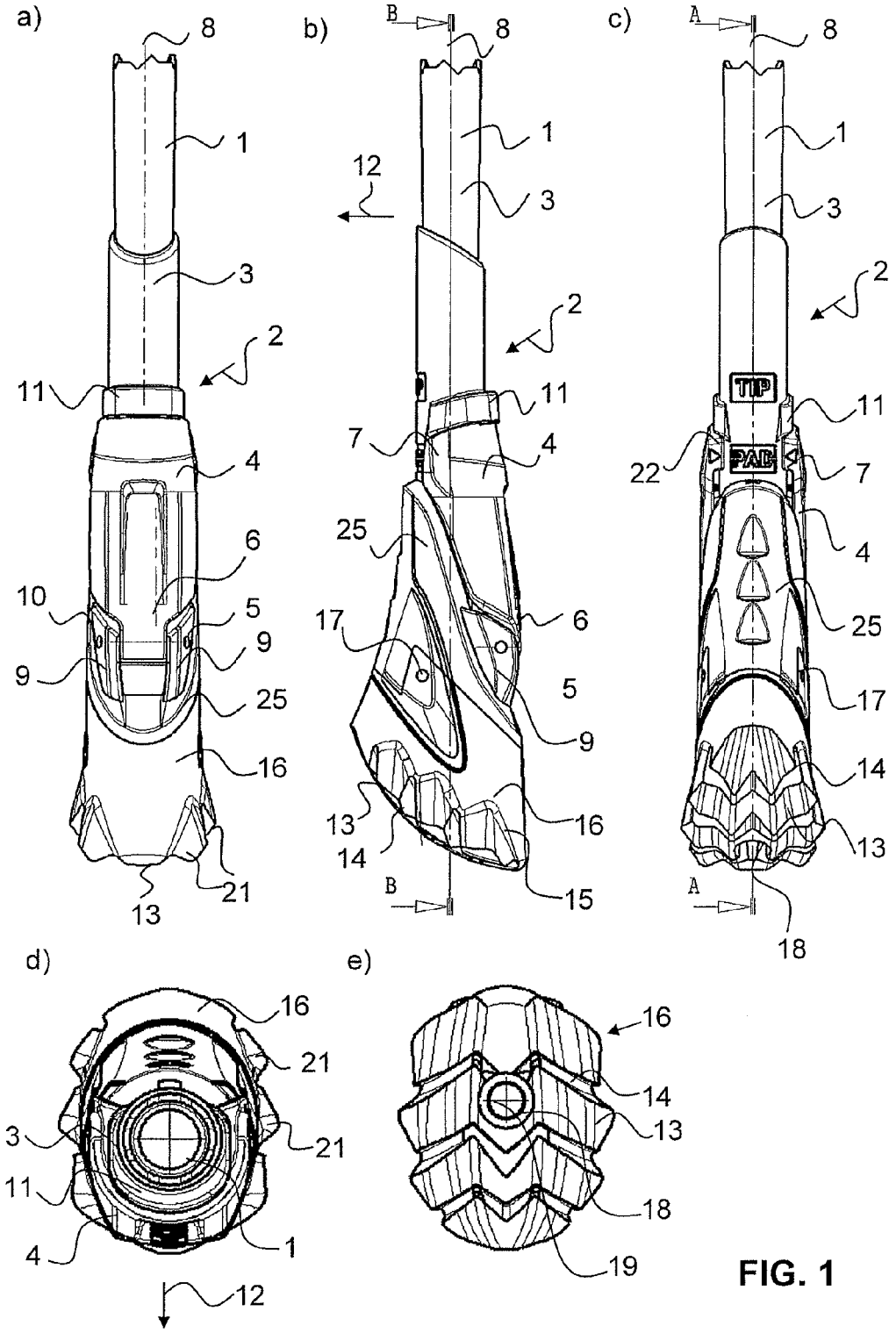
FIG. 1 shows in various views a buffer according to a first exemplary embodiment in the position in which the tip is concealed, where a) shows a view in the running direction from behind, b) shows a side view, c) shows a view in the running direction from the front, d) shows a view from above, e) shows a view from below of the rolling surface, f) shows a section along A-A in Figure c), g) shows a section along B-B in Figure b) and h) shows a perspective view.
Figure 1:
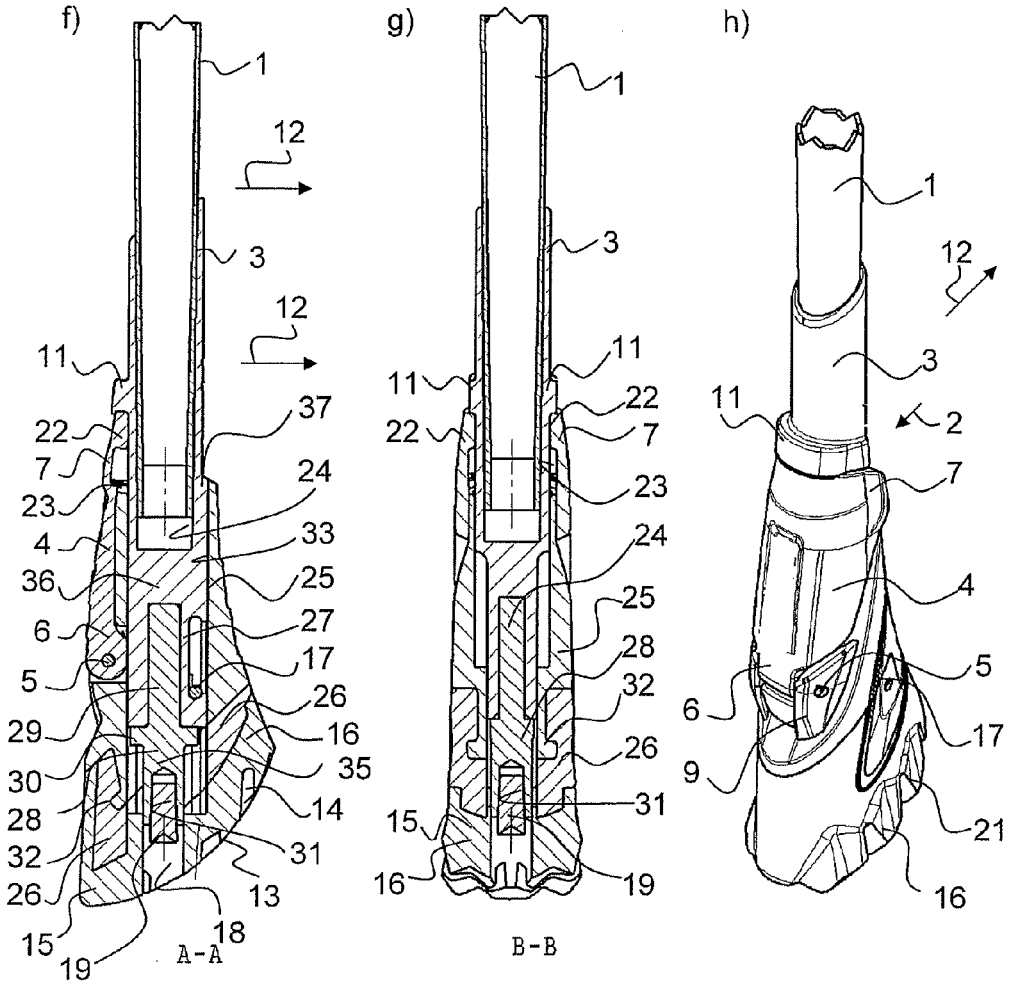
Figure 2:
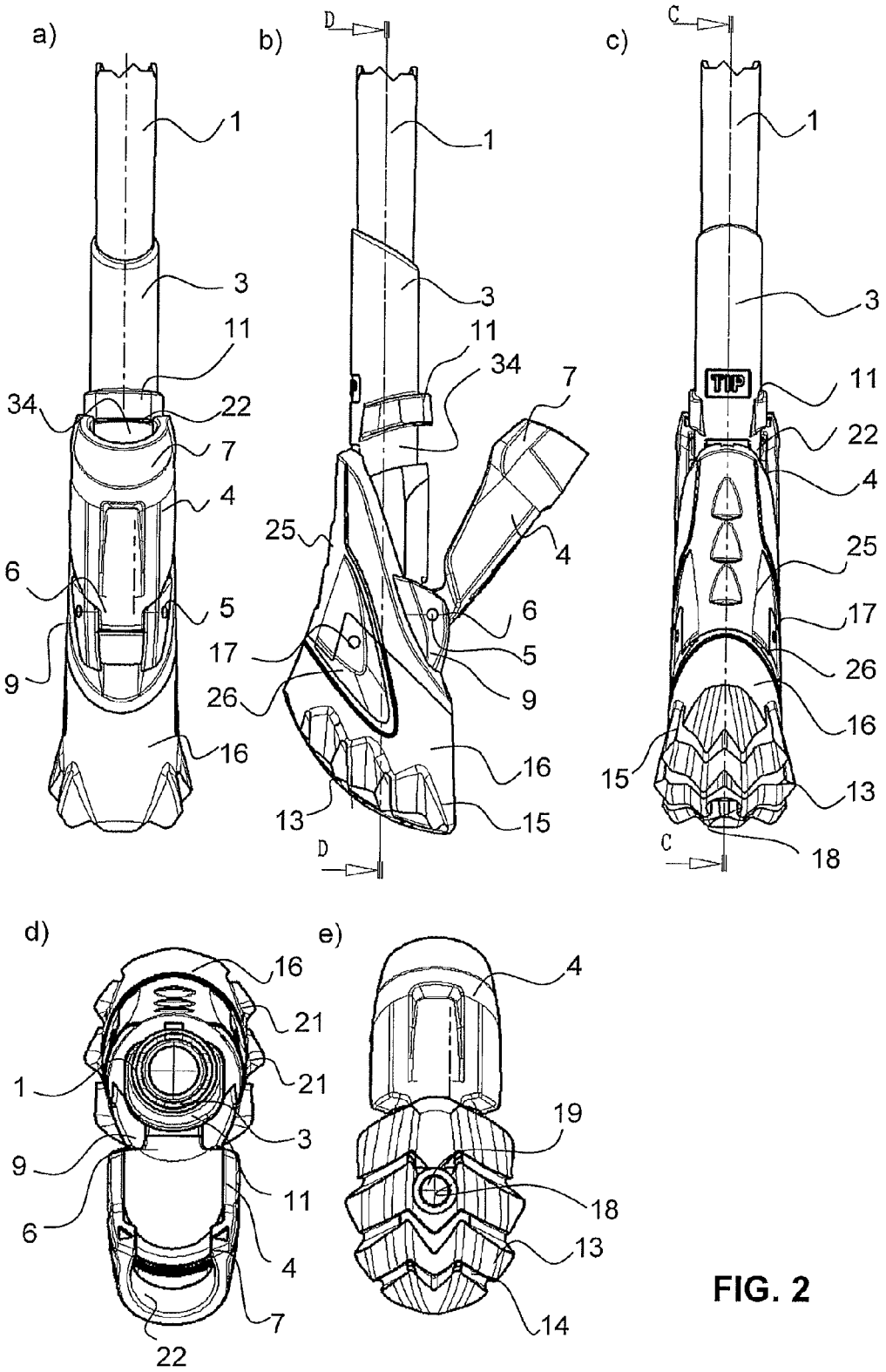
FIG. 2 shows in various views a buffer according to a first exemplary embodiment in the position in which the securing mechanism is released and the outer sleeve is already displaced upwards by half the distance, where a) shows a view in the running direction from behind, b) shows a side view, c) shows a view in the running direction from the front, d) shows a view from above, e) shows a view from below of the rolling surface, f) shows a section along C-C in Figure c), g) shows a section along D-D in Figure b) and h) shows a perspective view.
Figure 2:
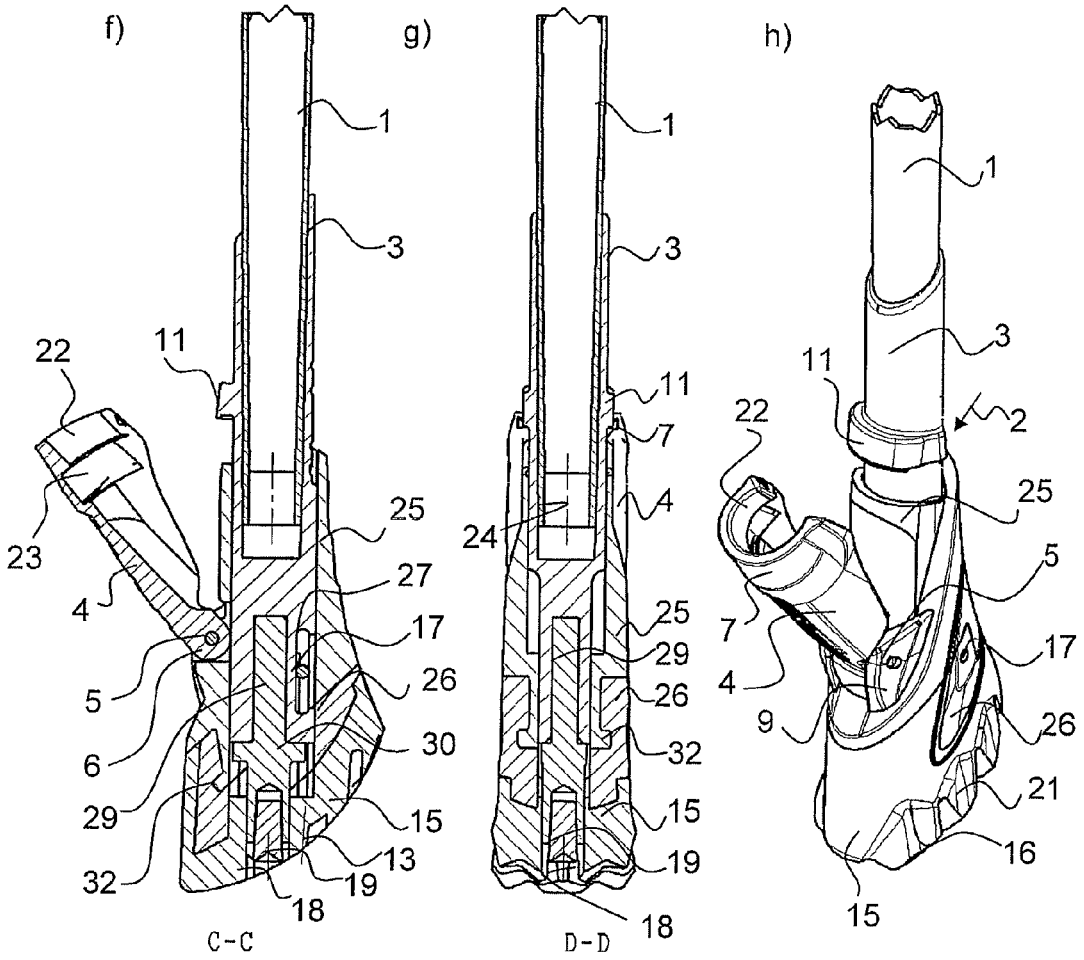
Figure 3:
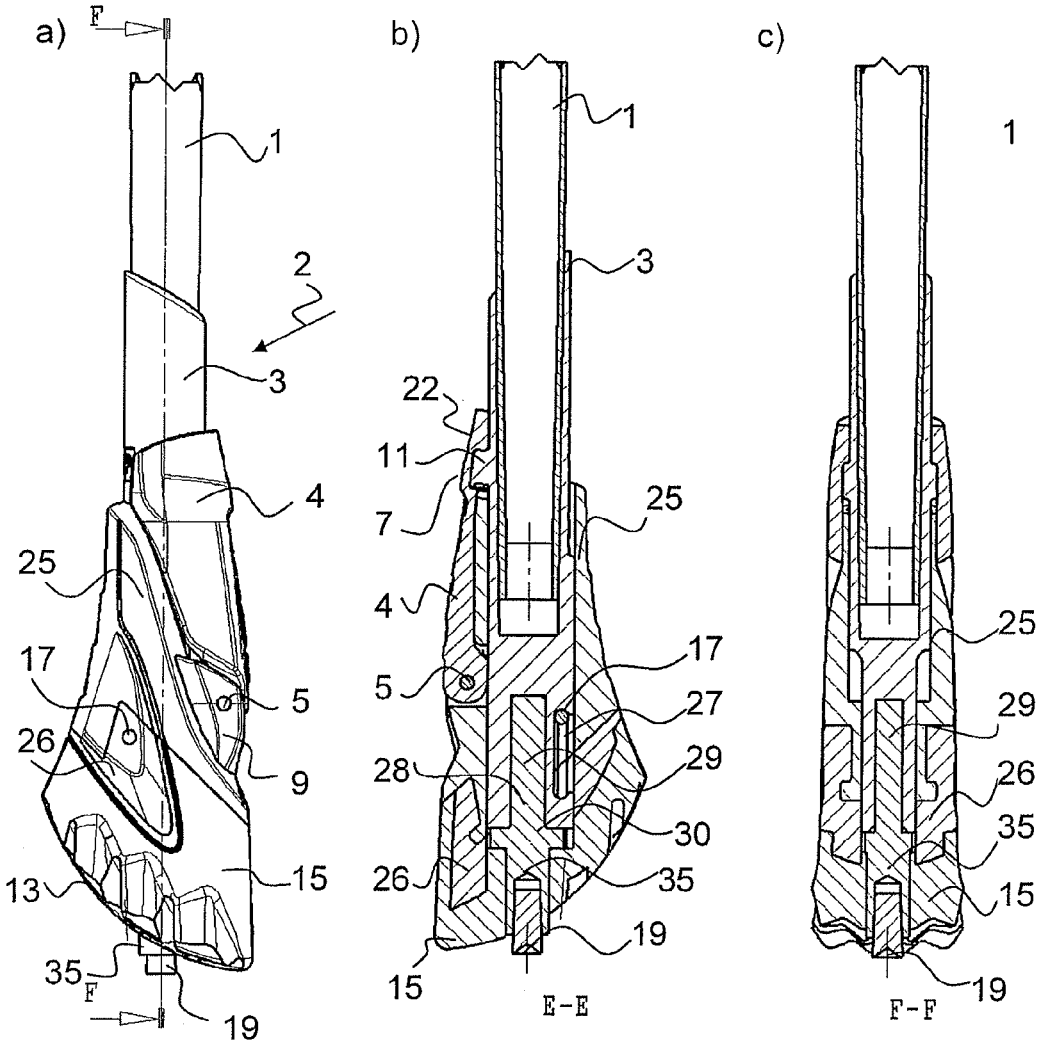
FIG. 3 shows in various views a buffer according to the first exemplary embodiment in the secured position, in which the tip projects downwards over the rolling surface, where a) shows a side view, b shows a section similar to the section according to FIG. 2*f*) or FIG. 1*f*) and c) shows a section similar to the section according to FIG. 2*g*) or FIG. 1*g;*

FIGS. 1-3 show a first exemplary embodiment of a pole or a buffer of a design according to the present invention. The same reference numbers in all these figures denote the same components.

FIG. 1 shows different views of this buffer according to the first exemplary embodiment in that position in which the tip is retracted. FIG. 2 shows different views of the situation in which the securing mechanism is released and the outer sleeve is already displaced half the distance to the fixed tip. FIG. 3 shows different views of that fixed position in which the tip projects over the rolling surface. As can be seen in particular from FIG. 1, the buffer comprises an inner sleeve 2 which has a central recess 24 in which the lower end of a tube body, which tapers conically here, is pressed and/or glued in. The upper region of this inner sleeve 3 to a certain extent forms a cuff which surrounds the pole body. The inner sleeve 3 has an upper region 37 which forms this cuff and serves to receive the pole tube and for securing the positive connection in the two positions of the buffer. In addition, a lower part 36 of the inner sleeve 3 follows in the downward direction and formed in one piece with the upper part 37. The actual tip 19 made of a wear-resistant material such as, for example, metal, hard metal, ceramic or a combination of these materials is secured at the lower end to this lower part 36. This is not directly but via a securing element 28 which typically consists of metal or hard metal.

The lower region 36 of the inner sleeve 3 has an axial recess in which an upper securing stub 29 of the securing element 28 is let in or secured. As can be identified in particular with reference to the sectional views according to FIGS. 1*f* and *g*, this securing stub 29 has a greater width in the running direction (FIG. 1*f*) than transversely to the running direction (FIG. 1*g*). The recess in the lower part 36 of the inner sleeve is configured accordingly and not circular. Preferably this upper securing stub 29 is an originally cylindrical region laterally flattened. This non-circular configuration of the upper securing stub 29 ensures that the securing element 28 is secured in a rotation-preventing manner in the inner sleeve.

This is followed in the downward direction by a flange formed on the upper securing stub 29 and in one piece with this, which rests with its upper side on the downwardly directed end surface of the inner sleeve 3. This flange 30 is only formed to the front and rear when viewed in the running direction (compare FIG. 1*f*) but not in the lateral direction since the space relationships in the lateral direction do not allow such a flange. The flange 30 on the one hand allows a clear impact point for the securing of the securing element 28 in the inner sleeve but on the other hand a defined lower impact point for the position in which the tip projects downwards over the rolling surface (compare in particular the sectional view according to FIG. 3*b*).

This is followed in the downward direction on this flange 30 on the securing element 28 by a lower securing stub 35 which has a recess 31 in the downward direction, in which the actual separate tip 19 consisting of a hard material as described above is pressed or glued in. The entire lower securing stub 35 and the tip 19 have a cross-sectional shape which is adapted to a through-opening provided in an attachment 16 or the elastic region 15 and the securing region 26 so that in different positions of the outer sleeve 25 relative to the inner sleeve 3 the tip 19 can be displaced through this through-opening 18.

An outer sleeve 25 is located on the lower region 36 of the inner sleeve 3 mounted displaceably in the axial direction. A latching lever 4 is articulated on the outer side of this outer sleeve 25, which lever has two bearing extensions 9 of the outer sleeve 25 formed towards the back in the running direction, which having two aligned axial holes 10. The latching lever 4 is secured between these two bearing extensions 9. For this purpose a tapered region 6 of the latching lever engages between the two bearing extensions 9, which region has a through-opening and an axis of rotation 5, typically a metal pin, is inserted between the two axial holes 10 and this through-opening so that the latching lever 4 is pivotably mounted about this axis on the outer sleeve 25.

At its upper end this latching lever 4 has a clamp region 7. With this clamp region 7 the latching lever embraces the upper part 37 of the inner sleeve 3 in a self-latching manner in the fixed position of the buffer. On the inner side of this clamp region 7, for precise fixing of the positive connection in both positions, on the one hand there is a radially inwardly extending contact region 22 located on the inside on the circumference and an undercut 23 in the sense of a similarly circumferential groove following directly below.

The axial displaceability of the outer sleeve is furthermore ensured by a guide recess 27 provided in the lower region 36 of the inner sleeve 3, which is configured to be elongated in the axial direction. A transversely running guide pin 17 which is secured in the outer sleeve 25 engages in this guide recess 27. In the lower position of the outer sleeve 25, as can be seen in particular from FIG. 1*f*, this guide pin 17 rests on the lower stop point of the guide recess 27. On the other side, the contact region 22 of the lever 4 acts positively from below on a circumferential latching extension 11 in the upper region 37 of the inner sleeve. Accordingly, in the lower position of the outer sleeve 25 as shown in FIG. 1, the outer sleeve is fixed in this position whereby one stop is given by the relative position of the guide pin 17 in the guide recess 27 on the lower stop and on the other side by contact of the stop region 22 on the lower surface of the latching extension 11.

On the lower side of the outer sleeve 25 a detachable attachment 16 is provided in this design so that according to requirements, another softer buffer region can be placed thereon, for example, different degrees of hardness of the buffer can be characterised by different colours.

This attachment 16 comprises a securing region 26 typically made of hard plastic as well as an elastic region 15 typically injection moulded on this region 26, the lower side of which forms the rolling surface 13 with a profile 14. The rolling surface 13 is here configured asymmetrically and is in particular raised further towards the front in the running direction in order to be optimally matched to the running direction for Nordic walking. The tip 19 passes through this rolling surface approximately in the rear third. In addition, the profiling has lateral extensions 21.

Such an attachment 16 is now secured to the outer sleeve 25 by being pushed onto a projection 32 on the outer sleeve and then the guide pin 17 already discussed above being inserted laterally. The guide pin 17 is used at the same time for securing the attachment 16, whereby the attachment has two aligned through-openings provided in two laterally arranged wings of the same which grip around the outer sleeve, through which the transverse pin 17 passes.

From the, to a certain extent, lower position of the outer sleeve 25 relative to the inner sleeve 3, as shown in FIG. 1, such a buffer can be displaced into the position with extended tip according to FIG. 3, whereby the lever 4, as shown in FIG. 2, is pivoted laterally outwards so that the contact region 22 releases the latching extension 11. Then, the outer sleeve 25 can be successively displaced upwards within the framework of the movability of the guide pin 17 in the guide recess 27. FIG. 2 shows a middle position of the axial displacement of the outer sleeve 25 relative to the inner sleeve 3.

FIG. 3 now shows the position in which the outer sleeve 25 has been pushed through the stop of the axial movability predefined by the recess 27 or the securing pin 17 and the lever 4 has again been placed onto the inner sleeve and has snapped around the inner sleeve in a self-latching manner to a certain extent. In this upper position of the outer sleeve, the contact region now lies above the latching extension 11 and the latching extension 11 engages positively in the undercut 23. In this second position the upper region of the latching lever 4 therefore defines a complete positive securing and the lower stop predefined by the guide recess 27 or the guide pin 17 is not absolutely necessary but is possible.

Figure 4:
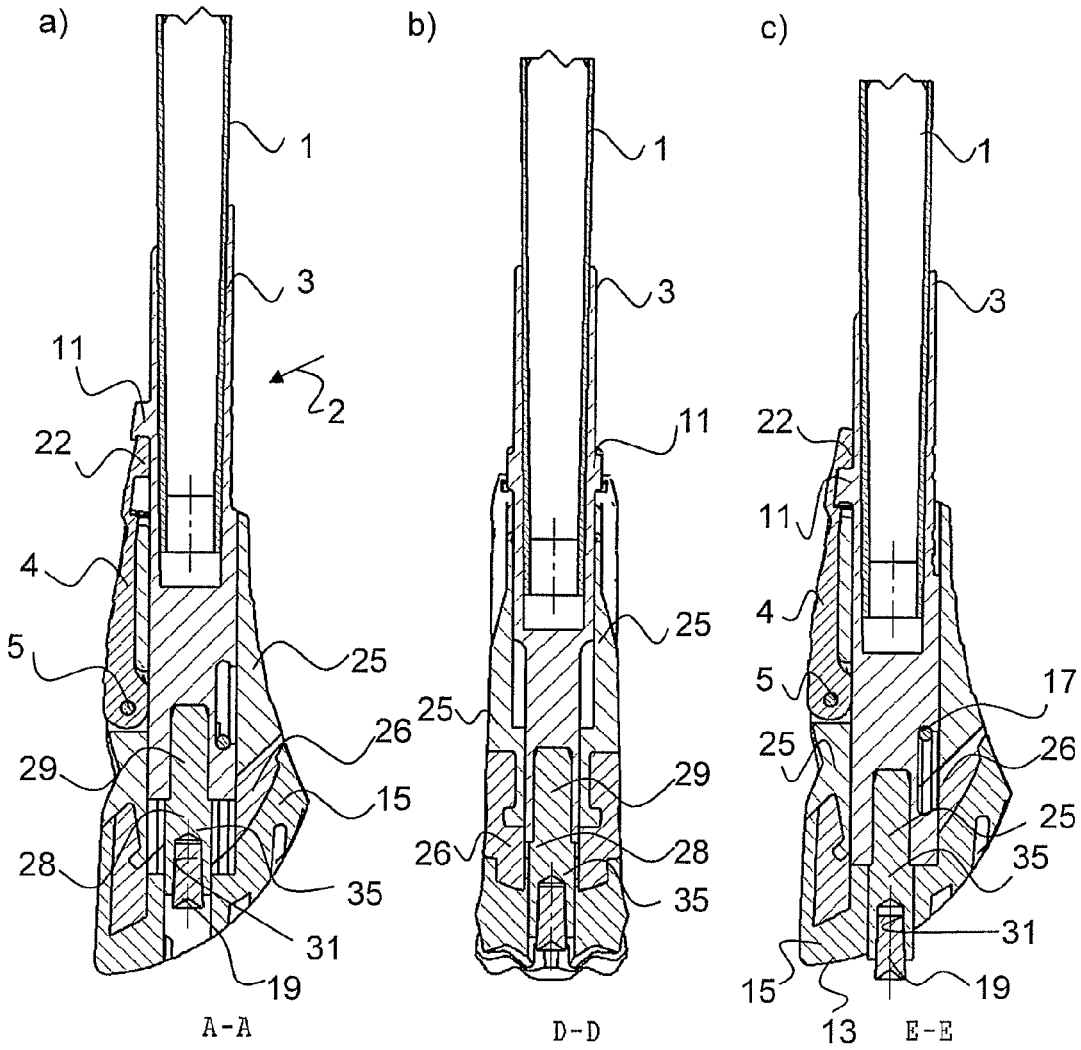
FIG. 4 shows a buffer according to a second exemplary embodiment, where a) shows a section similar to the section according to FIG. 1*f*) with retracted tip, b) shows a section similar to FIG. 2*g*) with extended tip and c) shows a section similar to FIG. 3*b*) with extended tip.

A slightly modified simplified design of such a buffer is shown in FIG. 4. An essential difference from the first exemplary embodiment is the configuration of the securing element 28, otherwise the external appearance and the other components are configured to be the same as in the first exemplary embodiment and accordingly the same reference numbers designate the same elements. In this exemplary embodiment the securing element 28 is configured as a simple stub without flange 30. The upper securing stub 29 has a circular cross-sectional surface, accordingly the securing element is a component which is easy to manufacture since it is circularly symmetrical.

REFERENCE LIST

1 Pole body
2 Buffer
3 Inner sleeve
4 Latching lever
5 Axis of rotation of 4
6 Tapered region of 4
7 Clamp region of 4
8 Pole axis
9 Bearing extensions of 25
10 Axial holes in 9
11 Latching extension on 25
12 Running direction
13 Rolling surface
14 Profile on 13
15 Elastic region of 16
16 Attachment
17 Securing pin for 16 on 25/guide pin
18 Through-opening in 16
19 Tip
21 Lateral extensions of 15
22 Contact region of 7
23 Undercut below 22
24 Recess in 2 for 1
25 Outer sleeve
26 Securing region of 16
27 Guide recess for 17
28 Securing element
29 Upper securing stub of 28
30 Flange of 28
31 Recess in 28 for 20
32 Projection
33 Guide opening in 25 for 3
34 Tapering below 11
35 Lower securing stub of 28 for 20
36 Lower region of 3
37 Upper region of 3

The invention claimed is:

1. A pole having a pole body, at the lower end of which a buffer with a tip is provided, wherein the tip and/or a lowermost portion of an inner sleeve, the inner sleeve being secured to the pole body, is arranged passing through a central opening of the buffer, wherein the buffer is mounted so that it can be moved and secured in an axial direction to the pole body in this central opening, and wherein the buffer can be secured in at least two axially different positions in relation to the pole body or the inner sleeve via a form-fit connection, wherein the buffer comprises an outer sleeve engaging around and mounted axially movably on the inner sleeve, on an outside of which outer sleeve a latching lever is articulated, wherein the latching lever, at its lower end directed towards a rolling surface at a lower end of the buffer, is articulated on the outer sleeve and, at its upper end in the secured position of the buffer, engages around the pole body and/or the inner sleeve at least partially with a form fit and can be released by being pivoted away from the outer sleeve, and wherein the outer sleeve comprises a buffer attachment at a lower end thereof, which can be detachably secured to the outer sleeve, with the aid of a securing pin running transversely to a pole axis, which at the same time serves as an anti-turn device for the displacement of the outer sleeve on the inner sleeve, wherein the securing pin is a guide pin engaging in a guide recess of the inner sleeve which is offset the pole axis to allow an axial displacement but not twisting of the outer sleeve relative to the inner sleeve about the pole axis.

2. The pole according to claim 1, wherein the latching lever in the secured position of the buffer engages at least partially around the inner sleeve.

3. The pole according to claim 2, wherein an at least partially circumferential extension and/or an at least partially circumferential indentation is provided on the inner sleeve in the engagement region of the lever, on or in which the upper end of the latching lever acts or engages positively.

4. The pole according to claim 3, wherein on an inner side of the upper end of the latching lever, a projection in the form of a contact region is provided on the circumference of the inner sleeve and an undercut following directly in a direction of an axis of rotation of the latching lever is provided for contact on the circumference of the extension in at least one secured position.

5. The pole according to claim 1, wherein an axis of rotation of the latching lever is disposed substantially perpendicular to the pole axis.

6. The pole according to claim 1, wherein the inner sleeve and the outer sleeve consist of a substantially inflexible hard plastic and the buffer attachment is formed from an elastomeric material or from a securing region having an elastomeric region forming the rolling surface.

7. The pole according to claim 1, wherein in an upper region the inner sleeve has an axial recess for receiving and securing the pole body and the tip is secured in a lower region of the inner sleeve.

8. The pole according to claim 7, wherein the tip is secured on the lower region of the inner sleeve by means of a securing element, which has an upper securing stub which is secured in a recess in the lower region, and adjoining in the downward direction, a flange followed in the downward direction by a lower securing stub in which the tip is let in a recess.

9. The pole according to claim 7, wherein the tip is secured on the lower region of the inner sleeve by means of a securing element, which has an upper securing stub which is secured in a recess in the lower region, and adjoining in the downward direction, a flange only extending in the running direction towards the front and back followed in the downward direction by a lower securing stub in which the tip, made of hardened and/or coated metal or of ceramic or of a combination of such materials, is let in a recess, wherein the upper securing stub has a non-circular cross-section.

10. The pole according to claim 1, wherein the outer sleeve can be fixed in two positions relative to the inner sleeve, wherein in an upper position of the outer sleeve the tip is arranged so that it projects downwards over the rolling surface, and wherein in a lower position of the outer sleeve the tip does not project over the rolling surface, and wherein these two positions are each fixed positively by means of the latching lever.

11. The pole according to claim 1, wherein the latching lever in the secured position of the buffer engages at least partially around the inner sleeve, by more than half a circumference of the inner sleeve.

12. The pole according to claim 1, wherein an axis of rotation of the latching lever is disposed substantially perpendicular to the pole axis and wherein outwardly projecting bearing extensions are provided on the outer sleeve in order to mount this axis of rotation in axial holes.

13. The pole according to claim 1, wherein the inner sleeve and the outer sleeve as well as the latching lever consist of a substantially inflexible hard plastic and the buffer attachment is formed from an elastomeric material or from a securing region having an elastomeric region forming the rolling surface.

14. The pole according to claim 1, wherein in an upper region the inner sleeve has an axial recess for receiving and securing the pole body and the tip is secured in a lower region of the inner sleeve, wherein the tip comprises a metal tip, made of hardened and/or coated metal or of ceramic or of a combination of such materials, and wherein the tip is secured in an axial recess of the lower part of the inner sleeve.

15. The pole according to claim 1, wherein the outer sleeve can be fixed in two positions relative to the inner sleeve, wherein in an upper position of the outer sleeve the tip is arranged so that it projects downwards over the rolling surface, projecting in the range of 2-10 mm, and wherein in a lower position of the outer sleeve the tip does not project over the rolling surface, wherein this is arranged in this second position 2-10 mm above the rolling surface and embedded in the buffer, and wherein these two positions are each fixed positively by means of the latching lever.

16. A method for mounting a pole according to claim 1, wherein the outer sleeve without attachment is pushed onto the inner sleeve and wherein the attachment is then put in place and is secured with the securing pin on the outer sleeve, wherein the securing pin engages in the guide recess in the inner sleeve so that inner sleeve and outer sleeve are only displaceable in the axial region predefined by the guide recesses.

17. The method according to claim 16, wherein the inner sleeve is secured on the pole body.

18. The method according to claim 16, wherein the inner sleeve is secured on the pole body, by securing the pole body in a recess in the upper region of the inner sleeve, wherein the tip can be secured by means of a securing element on the inner sleeve or can be secured thereafter on the inner sleeve.

19. A buffer for a pole, comprising a tip, wherein the tip and/or a lowermost portion of an inner sleeve, the inner sleeve being designed to be secured to a pole body, is arranged passing through a central opening of the buffer, wherein the buffer is mounted so that it can be moved and secured in an axial direction to a pole body in this central opening, and wherein the buffer can be secured in at least two axially different positions in relation to the pole body or the inner sleeve via a form-fit connection, wherein the buffer comprises an outer sleeve engaging around and mounted axially movably on the inner sleeve, on an outside of which outer sleeve a latching lever is articulated, wherein the latching lever, at its lower end directed towards a rolling surface at a lower end of the buffer, is articulated on the outer sleeve and, at its upper end in the secured position of the buffer, engages around the pole body and/or the inner sleeve at least partially with a form fit and can be released by being pivoted away from the outer sleeve, and wherein the outer sleeve comprises a buffer attachment at a lower end thereof, which can be detachably secured to the outer sleeve, with the aid of a securing pin running transversely to a pole axis, which at the same time serves as an anti-turn device for the displacement of the outer sleeve on the inner sleeve, wherein the securing pin is a guide pin engaging in a guide recess of the inner sleeve which is offset the pole axis to allow an axial displacement but not twisting of the outer sleeve relative to the inner sleeve about the pole axis.

* * * * *